United States Patent [19]

Saito et al.

[11] Patent Number: 4,533,266

[45] Date of Patent: Aug. 6, 1985

[54] INKED RIBBON CARTRIDGE FOR AN IMPACT SERIAL PRINTER

[75] Inventors: Shojiro Saito; Noriyoshi Azumaya, both of Tokyo, Japan

[73] Assignee: Nippon Electric Co., Ltd., Tokyo, Japan

[21] Appl. No.: 661,870

[22] Filed: Oct. 16, 1984

Related U.S. Application Data

[63] Continuation of Ser. No. 434,071, Oct. 12, 1982, abandoned.

[30] Foreign Application Priority Data

Oct. 9, 1981 [JP] Japan ..... 56-150639[U]

[51] Int. Cl.[3] ..... B41J 35/28

[52] U.S. Cl. ..... 400/208; 400/234

[58] Field of Search ..... 400/207, 208, 208.1, 400/234

[56] References Cited

U.S. PATENT DOCUMENTS

| | | | |
|---|---|---|---|
| 4,010,839 | 3/1977 | Guerrini et al. | 400/208 |
| 4,350,454 | 9/1982 | Schoenlein | 400/208 |
| 4,373,824 | 2/1983 | Olsen | 400/208 |

FOREIGN PATENT DOCUMENTS

| | | | |
|---|---|---|---|
| 0036308 | 9/1981 | European Pat. Off. | 400/208 |
| 2081220 | 2/1982 | United Kingdom | 400/208 |

OTHER PUBLICATIONS

Bullock et al., "Constant Tension Ribbon Cartridge, Oct. 1980, pp. 1741–1742, IBM Tech. Disc. Bull, vol. 23, No. 5.

*Primary Examiner*—Edgar S. Burr
*Assistant Examiner*—Charles A. Pearson
*Attorney, Agent, or Firm*—Sughrue Mion Zinn Macpeak & Seas

[57] ABSTRACT

An inked ribbon cartridge having an inked ribbon to be used for printing by an impact printer includes first and second cores having the ribbon wound thereon, and first and second ratchet cores directly coupled to the first and second ribbon cores. In addition, first and second levers have first ends which are selectively engaged with the first and second ratchet cores while opposite ends of the first and second levers are in contact with the inked ribbon for detecting a tension in the inked ribbon. Accordingly, the ribbon can be fed by providing a low torque to the first and second ribbon cores.

4 Claims, 1 Drawing Figure

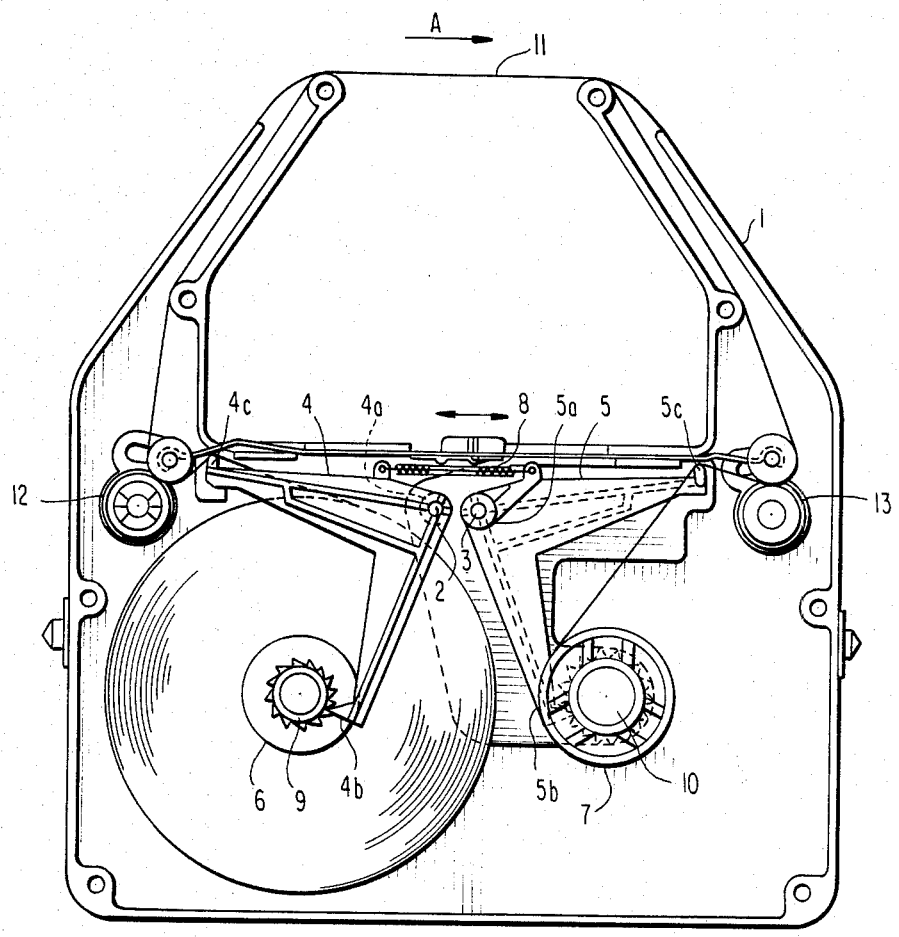
A
11
1
4c
4
4a
8
5a
5
5c
12
13
3
2
6
9
4b
5b
7
10

INKED RIBBON CARTRIDGE FOR AN IMPACT SERIAL PRINTER

This is a continuation, of application Ser. No. 434,071, filed 10-12-82, now abandoned.

BACKGROUND OF THE INVENTION

1. Field of the Invention

The present invention relates to an inked ribbon cartridge for an impact serial printer, and more particularly to a film ribbon cartridge for use in an impact serial printer or electronic typewriter which is required to have a high quality.

2. Description of the Prior Art

In an impact printer, an inked ribbon such as a cloth ribbon or a carbon film ribbon is used for printing on a paper by impacting it with formed characters or dot-wires. In order to improve the replacement of the inked ribbon, it is contained in a cartridge. Further, in cases where high printing quality is required, a carbon film ribbon is used. However, in view of the nature of the film, it is impossible to form a cartridge having an endless structure which could be repeatedly used for printing as is the case with the inked cloth ribbon.

There has been proposed, as described in the copending U.S. patent application Ser. No. 243,289 assigned to the present assignee, an inked ribbon cartridge having two sets of ribbon feed mechanisms, one for each core means around which the ribbon is wound, allowing the ribbon to travel back and forth so that the cartridge can be loaded upside down when the upper half of the ribbon has been used up thereby doubling the useful life of the cartridge. In this ribbon cartridge, two detent levers always apply a predetermined force to two ratchet wheels which are connected to two core means for preventing an over-rotation of the core means. In this over-rotation preventing mechanism, however, as the ribbon wound on the core is reduced, that is, the diameter of the wound ribbon is reduced, the ribbon tension is significantly increased. This means that more torque is required for taking up the ribbon.

SUMMARY OF THE INVENTION

It is, therefore, an object of the present invention to provide an inked ribbon cartridge having an over-rotation preventing mechanism in which a greater torque is not required.

According to the present invention, there is provided an inked ribbon cartridge in which one end of each of a set of self-lock levers are coupled to two ratchet cores. The other ends of the self-lock levers are in contact with the inked ribbon to detect the ribbon tension. When the detected tension is increased, the one end of the self-lock lever is automatically released from coupling with the ratchet core, whereby the ribbon tension is decreased.

BRIEF DESCRIPTION OF THE DRAWING

Other features and advantages of the present invention will be apparent from the following description of a preferred embodiment of the present invention taken in conjunction with the accompanying drawing which is a plan view of an embodiment of the present invention with a cover removed.

DESCRIPTION OF THE PREFERRED EMBODIMENTS

Referring to the drawing, axes 4*a* and 5*a* of a set of L-shaped self-lock levers 4 and 5 are pivotally fixed to shafts 2 and 3 on a cartridge housing 1, respectively. The lever 4 and 5 are provided at upper and lower sides of ribbon take-up/rewind cores 6 and 7 rotatably supported at their shafts 6*a* and 7*a* by the housing 1, and have first and second arms 41 and 42, and 51 and 52, respectively. In other words, remembering that the FIGURE is a top plan view of the ribbon cartridge, the lever 4 and its arms 41 and 42 are disposed above the core 6, while the lever 5 and its arms 51 and 52 are disposed below the core 7. The levers 4 and 5 are biased by means of a coil spring 8 so that first ends 4*b* and 5*b* are engaged with ratchet cores 9 and 10 directly coupled to cores 6 and 7, and including a plurality of ratchet teeth 9*a* and 9*b*, respectively. The housing 1 is substantially symmetrical with respect to the line S, and the core means 6 and 7, levers 4 and 5, etc., are also symmetrically positioned with respect to the line S.

An inked ribbon 11 extends from the core 6 through the other end 4*c* of the self-lock lever 4, ribbon feed mechanisms 12 and 13, the other end 5*c* of the self-lock lever 5 to the core 7.

As described in the above-mentioned copending application Ser. No. 243,289, the feed mechanisms 12 and 13 consist of drive rollers 14 and 15 and driven rollers 16 and 17. One of the drive rollers 14 and 15 is coupled to a motor shaft (not shown) to receive a rotational power. The axes of the driven rollers 16 and 17 are each movably displaced within elongated, elongated holes H formed in the housing 1, and the axes of the driven rollers 16 and 17 are also supported at either end of the sliding lever 18.

When the ribbon 11 is fed in a direction of an arrow A the lever 18 is slid to the right in the FIGURE to make the driven roller 17 contact the drive roller 15 which receives the rotational power. In this state, the driven roller 16 is removed from the drive roller 14. Therefore, the ribbon feed mechanism 13 is driven to pull the ribbon 11 out from the core 6, and the ribbon feed mechanism 12 is disengaged. The inked ribbon 11 wound around the core 6 passes from the core 6 through an unwind portion 11*a*, the end 4*c* of the lever 4, an engaging portion 11*b* between the rollers 14 and 16, out of the housing 1, through a printing portion, through an engaging portion 11*c* between the rollers 15 and 17, through an end 5*c* of the lever 5, and finally through the take-up portion 11*d* to the core 7. The ribbon 11 pulled out by the ribbon feed mechanism 13 is applied with an adequate tension by means of the self-lock lever 4 provided at the side of the core 6.

More specifically, the end 4*b* of the self-lock lever 4 is engaged with the ratchet core 9, whereby the rotation of the core 6 is prevented. When the ribbon 11 is pulled by the feed mechanism 13, the end 4*c* of the self-lock lever 4 is rotated counterclockwise owing to the ribbon tension, whereby the end 4*b* of the self-lock lever 4 is removed away from the ratchet core 9. Therefore, the ratchet core 9 and the core 6 become free, so that the ribbon 11 can be pulled out from the core 6. After the ribbon 11 has been pulled out, the self-lock lever end 4*b* is again engaged with the ratchet core 9 to prevent the over-rotation of the core 6.

Thus, the coupling and decoupling of the self-lock lever end 4*b* with the ratchet core 9 are alternately repeated in response to the predetermined ribbon tension detected by the self-lock lever end 4c. As the amount (that is, the diameter) of the ribbon 11 wound on the core 6 is reduced, the repetition period of the alternation between the coupling and decoupling is shortened, thereby to maintain the ribbon tension within the predetermined range.

When the ribbon 11 is fed in the direction A by the feed mechanism 13, the core 7 is driven by a belt (not shown) loosely stretched between the feed mechanism 13 and the core 7, as described in detail in the above-mentioned copending application Ser. No. 243,298. Therefore, the ribbon 11 is wound on the core 7.

The ratchet core 10 is designed so that the rotation of the core 7 is not prevented when the inked ribbon 11 is being wound on the core 7, while it is prevented when the inked ribbon 11 is being pulled out therefrom.

When the ribbon 11 has been completely wound on the core 7, the cartridge 1 is alternatively inverted or loaded upside down on a impact printer. Because the cartridge 1 has the symmetrical structure, the reverse ribbon feeding from the core 7 to the core 6 by driving the feed mechanism 12 is achieved in the same manner. Therefore, the description of the reverse feeding is omitted.

As described above, because the self-lock lever repeats the coupling and decoupling with the ratchet core in response to the predetermined ribbon tension detected thereby, the ribbon 11 can be fed by less torque.

What is claimed is:

1. An inked ribbon cartridge, comprising:

an inked ribbon for use in printing by a printer;

a symmetrical casing for housing said inked ribbon, said casing including first and second sections symmetrical to each other with respect to a center line thereof;

first core means rotatably supported by said casing and disposed in said first section, said first core means having a rotational shaft, said rotational shaft including a plurality of ratchet teeth formed around its circumferential surface;

second core means rotatably supported by said casing and disposed in said second section;

driving means disposed in said second section, and driving means being used for pulling and unwinding said inked ribbon wound around said first core means and for supplying said inked ribbon for said second core means;

driven means disposed in said first section, said driven means being used for guiding said inked ribbon from said first core means toward said driving means;

a path of said inked ribbon formed in said casing, said path including an unwind portion from said first core means, a first engaging portion with said driven means, a second engaging portion with said driving means and a take-up portion to said second core means;

first L-shaped lever means consisting of first and second arms connected in the shape of an L, said lever means being rotatably supported about a rotational axis located at the connection of said first and second arms, said rotational axis being supported by a pivot formed in said casing, said pivot being positioned at a position apart from said first core means by a distance which is greater than the maximum radius of winding of said inked ribbon wound around said first core means, said first arm projecting from said rotational axis and reaching to said rotational shaft of said first core means, said second arm having substantially the same length as said first arm and projecting from said rotational axis toward said driven means and having a ribbon engaging projection on the end remote from said rotational axis;

spring means for urging said lever means in a first rotational direction such that an end of said first arm engages said ratchet teeth of said first core means to prevent the rotation of said first core means and said projection of said second arm contacts and bends said path of said inked ribbon between said unwind portion and said first engaging portion to detect a tension thereof;

said lever means being rotated in a second rotational direction opposite to said first rotational direction by the tension of said inked ribbon on the projection of said arm which contacts said ribbon to disengage said first arm from said ratchet teeth to permit the rotation of said first core means only when said inked ribbon wound around said first core means is fed by said driving means and said tension of said inked ribbon is sufficient to overcome the urging force of said spring means.

2. The inked ribbon cartridge as claimed in claim 1, wherein said second core means further has a rotational shaft including a plurality of ratchet teeth formed around its circumferential surface, and each of said driving means and driven means further comprises a first roller and a second roller driven by said first roller.

3. The inked ribbon cartridge as claimed in claim 2, further comprising:

means for making said second roller of said driving means couple or decouple to said first roller of said driving means and for making said second roller of said driven means couple or decouple to said first roller of said driven means, said driving means feeding said inked ribbon when its second roller is coupled to its first roller and guiding said inked ribbon when its second roller is decoupled from its first roller, and said driven means feeding said inked ribbon when its second roller is coupled to its first roller and guiding said inked ribbon when its second roller is decoupled from its first roller; and second L-shaped lever means rotatably supported in said casing and having a third arm and a fourth arm, said second lever means being urged such that an end of said third arm engages said ratchet teeth of said second core means and such that an end of said fourth arm bends said path of said inked ribbon between said second engaging portion and said take-up portion;

said driving means, said second core means and said second lever means being respectively positioned symmetrically to said driven means, said first core means and said first lever means with respect to said center line.

4. The inked ribbon cartridge as claimed in claim 2, said first roller of said driving means being used for feeding said inked ribbon from said first core means to said second core means and said first roller of said driven means being used for feeding said inked ribbon from said second core means to said first core means.

* * * * *

UNITED STATES PATENT AND TRADEMARK OFFICE

CERTIFICATE OF CORRECTION

PATENT NO. : 4,533,266

DATED : August 6, 1985

INVENTOR(S) : Shojiro SAITO; Noriyoshi AZUMAYA, both of Tokyo Japan

It is certified that error appears in the above-identified patent and that said Letters Patent is hereby corrected as shown below:

Column 3, line 12, "243,298" should be --243,289--;

line 44, "and" should be --said--.

Signed and Sealed this

*Eighteenth* Day of *February 1986*

[SEAL]

*Attest:*

*Attesting Officer*

DONALD J. QUIGG

*Commissioner of Patents and Trademarks*